US006407510B1

(12) United States Patent
Yoo et al.

(10) Patent No.: US 6,407,510 B1
(45) Date of Patent: Jun. 18, 2002

(54) METHOD AND APPARATUS FOR DRIVING PLASMA DISPLAY PANEL

(75) Inventors: Jun Yeong Yoo, Seoul; Byung Soo Song; Dae Jin Myoung, both of Kyonggi-do, all of (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/758,232

(22) Filed: Jan. 12, 2001

(30) Foreign Application Priority Data

Jan. 13, 2000 (KR) ..... 00-01547
Nov. 2, 2000 (KR) ..... 00-64827

(51) Int. Cl.[7] ..... G09G 3/10

(52) U.S. Cl. ..... 315/169.4; 345/60; 345/76; 345/78

(58) Field of Search ..... 315/169.4, 169.1, 315/169.2; 345/55, 60, 63, 67, 68, 76, 78

(56) References Cited

U.S. PATENT DOCUMENTS 5,963,184 A * 10/1999 Tokunaga et al. ..... 345/60
6,144,374 A * 11/2000 Hyun ..... 345/204
6,236,380 B1 * 5/2001 Wani et al. ..... 345/60
6,243,084 B1 * 6/2001 Nagai ..... 345/210
6,271,810 B1 * 8/2001 Yoo et al. ..... 345/60

* cited by examiner

*Primary Examiner*—Don Wong
*Assistant Examiner*—Tuyet T. Vo
(74) *Attorney, Agent, or Firm*—Fleshner & Kim, LLP

(57) ABSTRACT

A plasma display panel driving method that permits a high-speed addressing. In the method, a data pulse is applied to address electrodes in an address interval for selecting discharge cells. An auxiliary data pulse is applied to the address electrodes in such a manner to be positioned at the front and rear portions of the data pulse when the data pulse is applied to the address electrodes. A scanning pulse is sequentially applied to scanning/sustaining electrodes.

17 Claims, 10 Drawing Sheets

METHOD AND APPARATUS FOR DRIVING PLASMA DISPLAY PANEL

BACKGROUND OF TH INVENTION

1. Field of the Invention

This invention relates to a technique for driving a plasma display panel, and more particularly to a plasma display panel driving method that permits a high-speed addressing. The present invention also is directed to a plasma display panel driving apparatus.

2. Description of the Related Art

Recently, a plasma display panel (PDP) feasible to a manufacturing of a large-dimension panel has been highlighted as a flat panel display device. The PDP typically includes a three-electrode, alternating current (AC) surface discharge PDP that has three electrodes and is driven with an AC voltage as shown in FIG. 1.

Referring to FIG. 1, a discharge cell of the three-electrode, AC surface discharge PDP includes a scanning/sustaining electrode 12Y and a common sustaining electrode 12Z formed on an upper substrate 10, and an address electrode 20X formed on a lower substrate 18. On the upper substrate 10 in which the scanning/sustaining electrode 12Y is formed in parallel to the common sustaining electrode 12Z, an upper dielectric layer 14 and a protective film 16 are disposed. Wall charges generated upon plasma discharge are accumulated in the upper dielectric layer 14. The protective film 16 prevents a damage of the upper dielectric layer 14 caused by the sputtering generated during the plasma discharge and improves the emission efficiency of secondary electrons. This protective film 16 is usually made from MgO. A lower dielectric layer 22 and barrier ribs 24 are formed on the lower substrate 18 provided with the address electrode 20X, and a fluorescent material 26 is coated on the surfaces of the lower dielectric layer 22 and the barrier ribs 24. The address electrode 20X is formed in a direction crossing the scanning/sustaining electrode 12Y and the common sustaining electrode 12Z. The barrier ribs 24 is formed in parallel to the address electrode 20X to prevent an ultraviolet ray and a visible light generated by the discharge from being leaked to the adjacent discharge cells. The fluorescent material 26 is excited by an ultraviolet ray generated upon plasma discharge to produce a red, green or blue color visible light ray. An active gas for a gas discharge is injected into a discharge space defined between the upper/lower substrate and the barrier rib.

As shown in FIG. 2, such a discharge cell is arranged in a matrix type. In FIG. 2, the discharge cell 1 is provided at each intersection among scanning/sustaining electrode lines Y1 to Ym, common sustaining electrode lines Z1 to Zm and address electrode lines X1 to Xn. The scanning/sustaining electrode lines Y1 to Ym are sequentially driven while the common sustaining electrode lines Z1 to Zm are commonly driven. The address electrode lines X1 to Xn are driven with being divided into odd-numbered lines and even-numbered lines.

Such a three-electrode, AC surface discharge PDP is driven with being separated into a number of sub-fields. In each sub-field interval, a light emission having a frequency proportional to a weighting value of a video data is conducted to provide a gray scale display. For instance, if a 8-bit video data is used to display a picture of 256 gray scales, then one frame display interval (e.g., 1/60second=16.7 msec) in each discharge cell 1 is divided into 8 sub-fields SF1 to SF8 as shown in FIG. 3. Each sub-field SF1 to SF8 is again divided into a reset interval, an address interval and a sustaining interval. A weighting value at a ratio of 1:2:4:8: . . . :128 is given in the sustaining interval. Herein, the reset interval is a period for initializing the discharge cell; the address interval is a period for generating a selective address discharge in accordance with a logical value of a video data; and the sustaining interval is a period for sustaining the discharge in a discharge cell in which the address discharge has been generated. The reset interval and the address interval are equally assigned in each sub-field interval.

FIG. 4 is waveform diagrams according to a conventional PDP driving method. Referring to FIG. 4, all of the cells are initialized by a reset discharge generated in the reset interval (not shown). In the address interval, a scanning pulse SP is sequentially applied to the scanning/sustaining electrode lines Y1 to Ym and a data pulse DP synchronized with the scanning pulse SP is applied to the address electrode lines X1 to Xn. At this time, an address discharge is generated at discharge cells supplied with the data pulse DP. In the sustaining interval, sustaining pulses SUSPy and SUSPz are alternately applied to the scanning/sustaining electrode lines Y1 to Ym and the common sustaining electrode lines Z1 to Zm to cause a sustaining discharge at the discharge cells selected by the address discharge.

In such a sub-field driving method, the sustaining interval must assure a sufficient time for a picture display interval so as to show an appropriate brightness. However, as a-PDP has a higher resolution, that is, as the number of scanning/sustaining electrode lines Y is more increased, an address interval for selecting the discharge cells are more enlarged. If an address interval is enlarged as mentioned above, then the sustaining interval for displaying a picture becomes relatively short to deteriorate a brightness of the PDP.

In order to solve the above-mentioned problem, a scheme of reducing a pulse width for the address discharge has been used. If a pulse width for the address discharge is reduced, however, the address discharge becomes unstable to increase an address failure probability. Particularly, if the number of the scanning/sustaining electrode lines Y is increased, then an address discharge should be generated for a very short time of about 1 $\mu$s per line. However, an address discharge at 1 $\mu$s fails to form sufficient wall charges at the discharge cells. A state of spatial charges become different for each discharge cell and an address discharge become unstable due to an affect of adjacent cells. As a result, a scheme capable of shortening an address interval in a state of keeping an address discharge time at more than 1 $\mu$s is required.

SUMMARY OF THE INVENTION

Accordingly, it is an object of the present invention to provide a plasma display panel (PDP) driving method and apparatus that permit a high-speed addressing.

In order to achieve these and other objects of the invention, a method of driving a plasma display panel according to one aspect of the present invention includes the steps of applying a data pulse to address electrodes in an address interval for selecting discharge cells; applying an auxiliary data pulse to the address electrodes in such a manner to be positioned at the front and rear portions of the data pulse when the data pulse is applied to the address electrodes; and sequentially applying a scanning pulse to scanning/sustaining electrodes.

A method of driving a plasma display panel according to another aspect of the present invention includes the steps of sequentially applying a scanning pulse to scanning/sustaining electrodes in an address interval for selecting discharge cells; applying an auxiliary scanning pulse in such a manner to be positioned at the front portion of the scanning pulse and overlap with the previous scanning pulse when the scanning pulse is applied to the scanning/sustaining electrodes; and applying any one of first and second data pulses having a different pulse width depending on a logical value of a data to address electrodes in an address interval.

A driving apparatus for a plasma display panel according to still another aspect of the present invention includes a plurality of shift registers to each of which a data is inputted; a plurality of memories for receiving said data stored in the shift registers and temporarily storing the received data; an auxiliary data generator for receiving said data stored in the memories to generate an auxiliary data; and an output device for receiving said data stored in the memories and said auxiliary data produced from the auxiliary data generator to output any one of said data and said auxiliary data.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
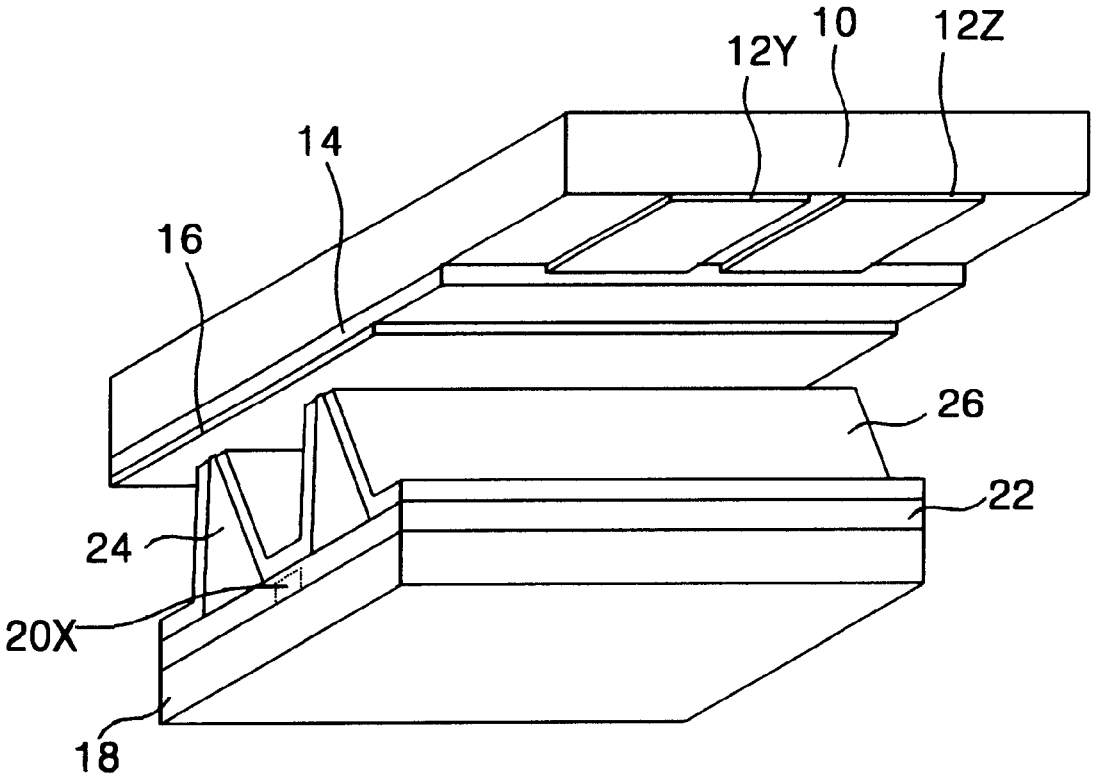
FIG. 1 RELATED ART
FIG. 1 is a perspective view showing a structure of a discharge cell of a conventional three-electrode, AC surface discharge plasma display panel.
Figure 2:
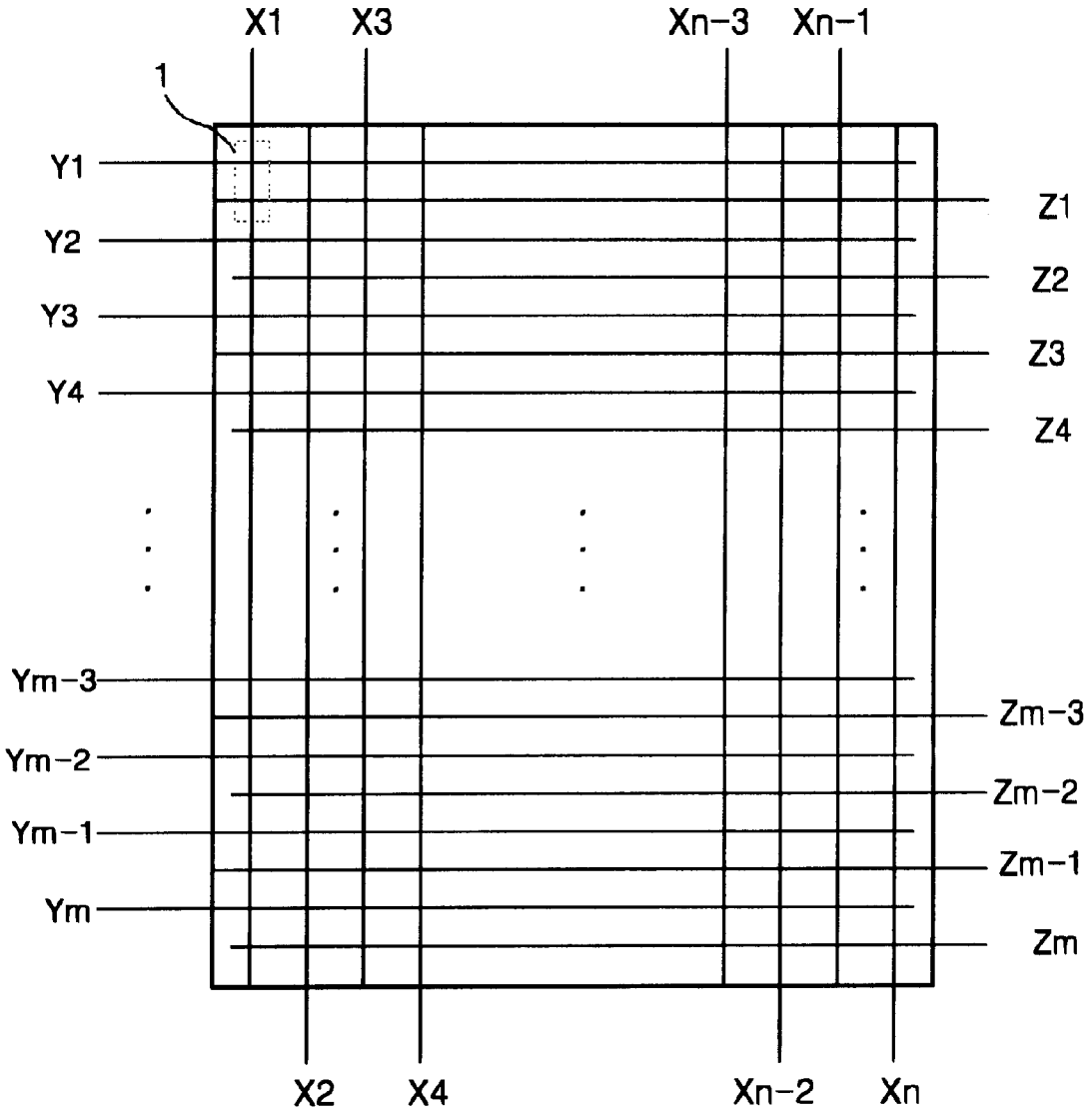
FIG. 2 RELATED ART
FIG. 2 illustrates an entire electrode arrangement of a plasma display panel including the discharge cells shown in FIG. 1.
Figure 3:
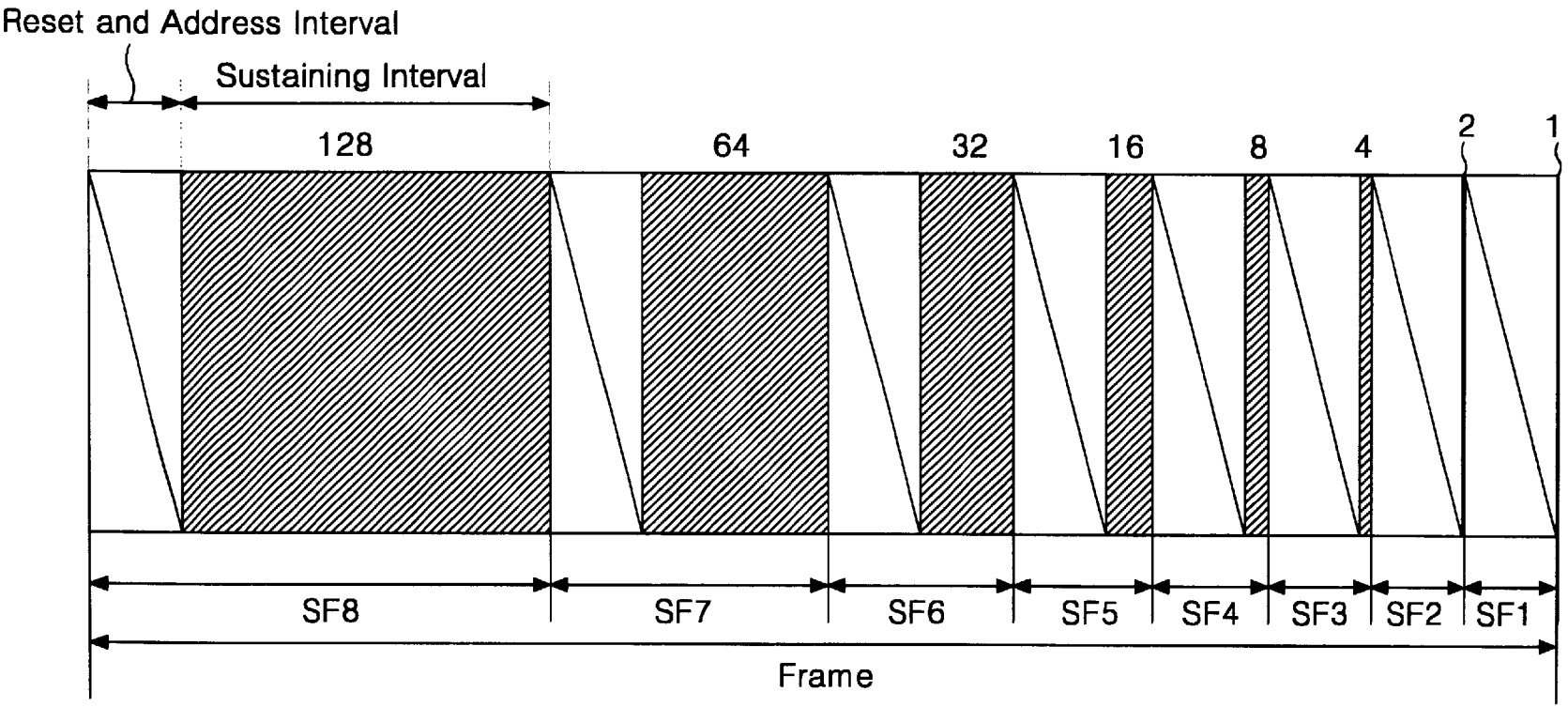
FIG. 3 RELATED ART
FIG. 3 illustrates one frame configuration for explaining a conventional sub-field driving method.
Figure 4:
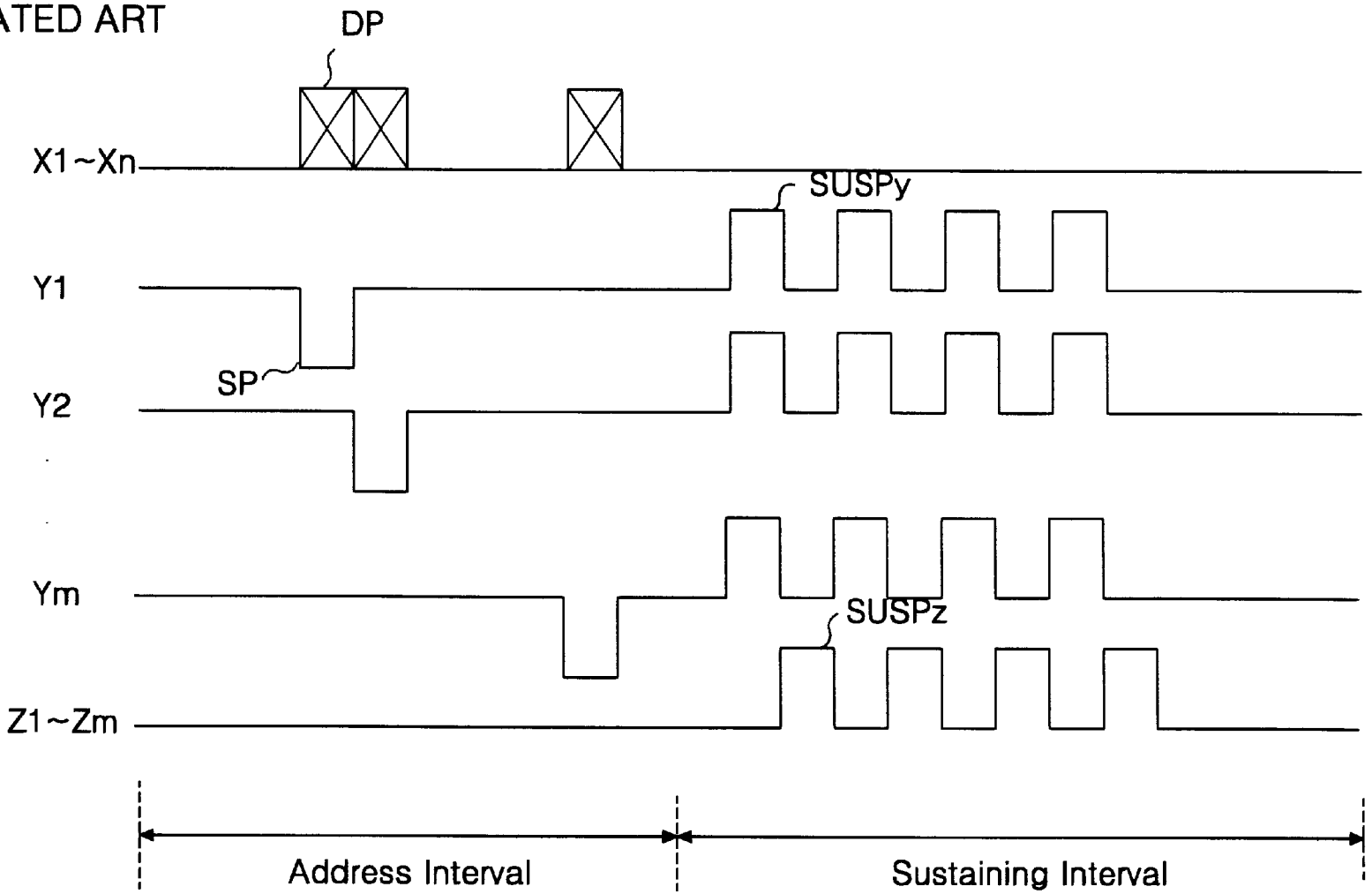
FIG. 4 RELATED ART
FIG. 4 is waveform diagrams showing a conventional plasma display panel driving method.
Figure 5:
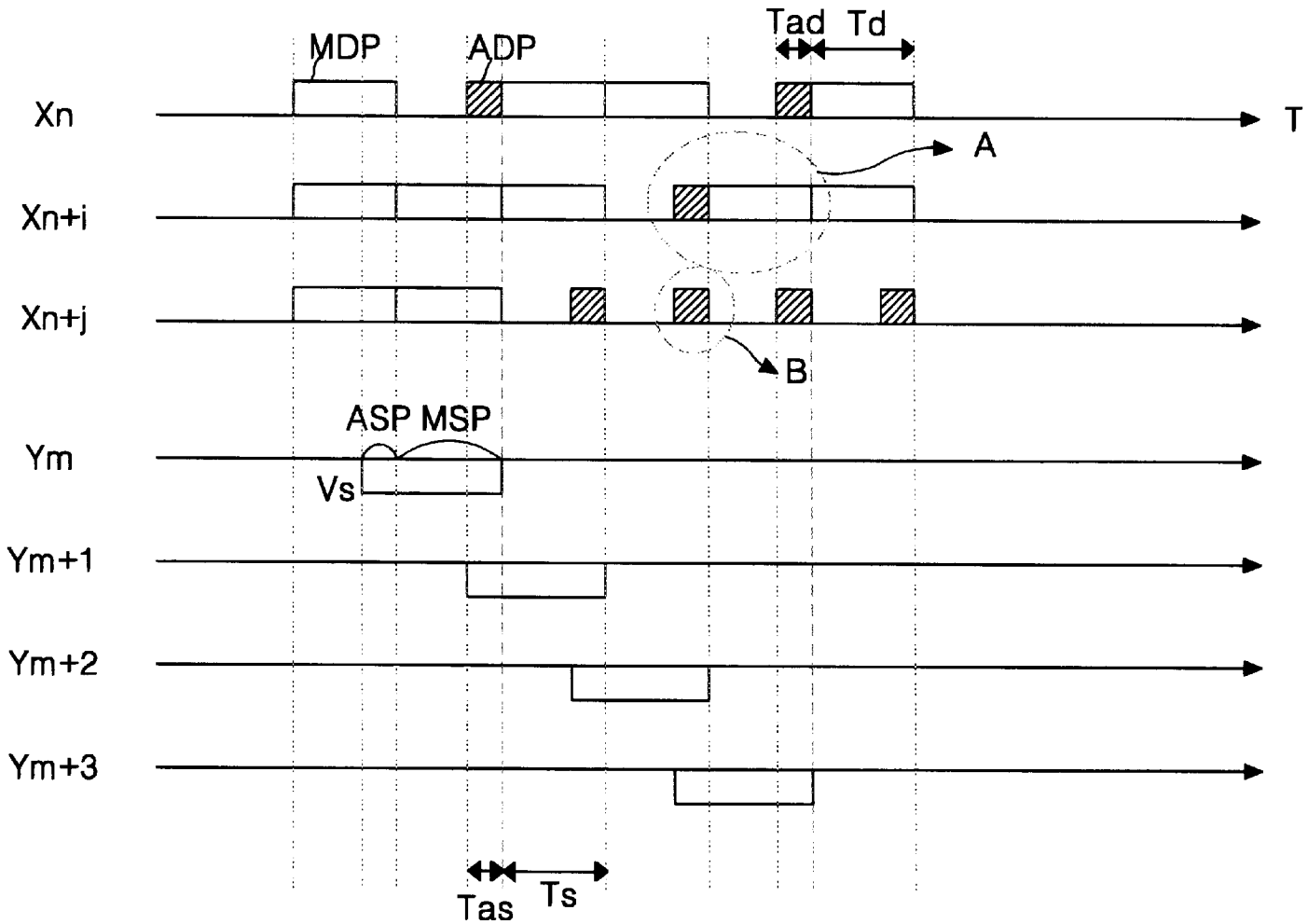
FIG. 5 is waveform diagrams showing a plasma display panel driving method according to a first embodiment of the present invention.

Referring to FIG. 5, there is shown a plasma display panel (PDP) driving method according to a first embodiment of the present invention. In the PDP driving method, a data pulse applied to address electrode lines Xn, Xn+i and Xn+j has a different pulse width in accordance with a logical value of a data. If a logical value of a data supplied to the address electrode line X is '1', then a main data pulse MDP having a small width Td (e.g., about 1 $\mu$s) is applied. If a logical value of a data supplied to the address electrode line X is '0', then an auxiliary data pulse ADP having a minute width Tad is applied. A main scanning pulse MSP corresponding to a pulse width of the main data pulse MDP and an auxiliary scanning pulse ASP corresponding to a pulse with of the auxiliary data pulse ADP. The auxiliary scanning pulse ASP precedes the main data pulse MDP, and a pulse width of the auxiliary scanning pulse ASP is added to that of the main data pulse MDP to make a scanning pulse. Such a scanning pulse is applied at a slightly earlier time, that is, a time earlier, by a width Tad of the auxiliary data pulse ADP, than an application time of the main data pulse MDP.

A scanning pulse applied to the $(Ym+1)^{th}$ scanning/sustaining electrode line Ym+1 overlaps with a scanning pulse applied to the $Ym^{th}$ scanning/sustaining electrode line Ym by a width of the auxiliary scanning pulse ASP. In this case, the auxiliary data pulse ADP and the auxiliary scanning pulse ASP play a role to supply priming particles for a short time without generating a normal address discharge. More specifically, the discharge cells supplied with the main data pulse MDP generate an auxiliary discharge at a region where the main data pulse MDP or the auxiliary data pulse ADP and the auxiliary scanning pulse ASP applied to the previous scanning/sustaining electrode line Y overlap with each other. Thereafter, the discharge cells generates a normal address discharge at a region where the main data pulse MDP and the main scanning pulse ASP applied to the scanning/sustaining electrode line Y overlap with each other. As a result, the discharge cells supplied with the main data pulse MDP generate an address discharge during a time of Tas+Ts as indicated by the dotted circular line A in FIG. 5. The discharge cells supplied with the auxiliary data pulse ADP generate an auxiliary discharge by the main scanning pulse MSP applied to the previous scanning/sustaining electrode line Y and the auxiliary data pulse ADP applied to the present scanning/sustaining electrode line Y as indicated by the dotted circular line B in FIG. 5. Such an auxiliary discharge is driven off due to being generated in very short time and allows only a priming effect to occur, when a main discharging is not continued.

Figure 6:
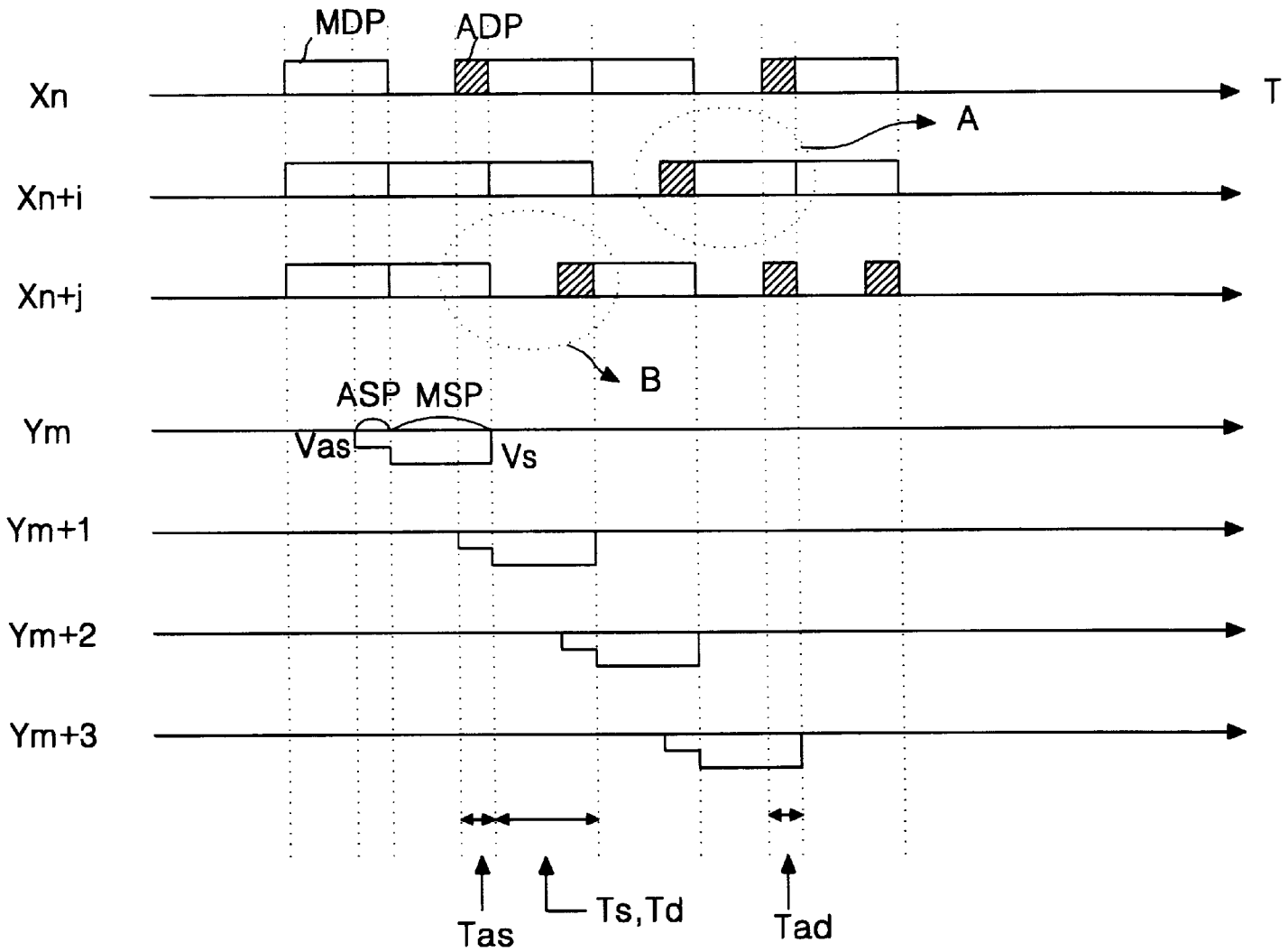
FIG. 6 is waveform diagrams showing a plasma display panel driving method according to another embodiment of the present invention.

Alternatively, in order to reduce a magnitude of the auxiliary discharge, a voltage Vas of the auxiliary scanning pulse ASP for the auxiliary discharge smaller than a voltage Vs of the main scanning pulse MSP for a normal address discharge may be applied as shown in FIG. 6 The magnitude of the auxiliary discharge can be smaller or lager. Accordingly, a voltage Vas of the auxiliary scanning pulse can be smaller or lager. This is determined by an amount of the auxiliary discharge to be demand.

The PDP driving method according to the first embodiment of the present invention as described above causes an auxiliary discharge when a logical value of a data is '1 'and generates an address discharge using priming charged particles produced by this auxiliary discharge, to thereby permits a high-speed addressing. Also, the PDP driving method permits a high-speed addressing by overlapping the scanning pulse applied to the scanning/sustaining electrode line Y.

Figure 7:
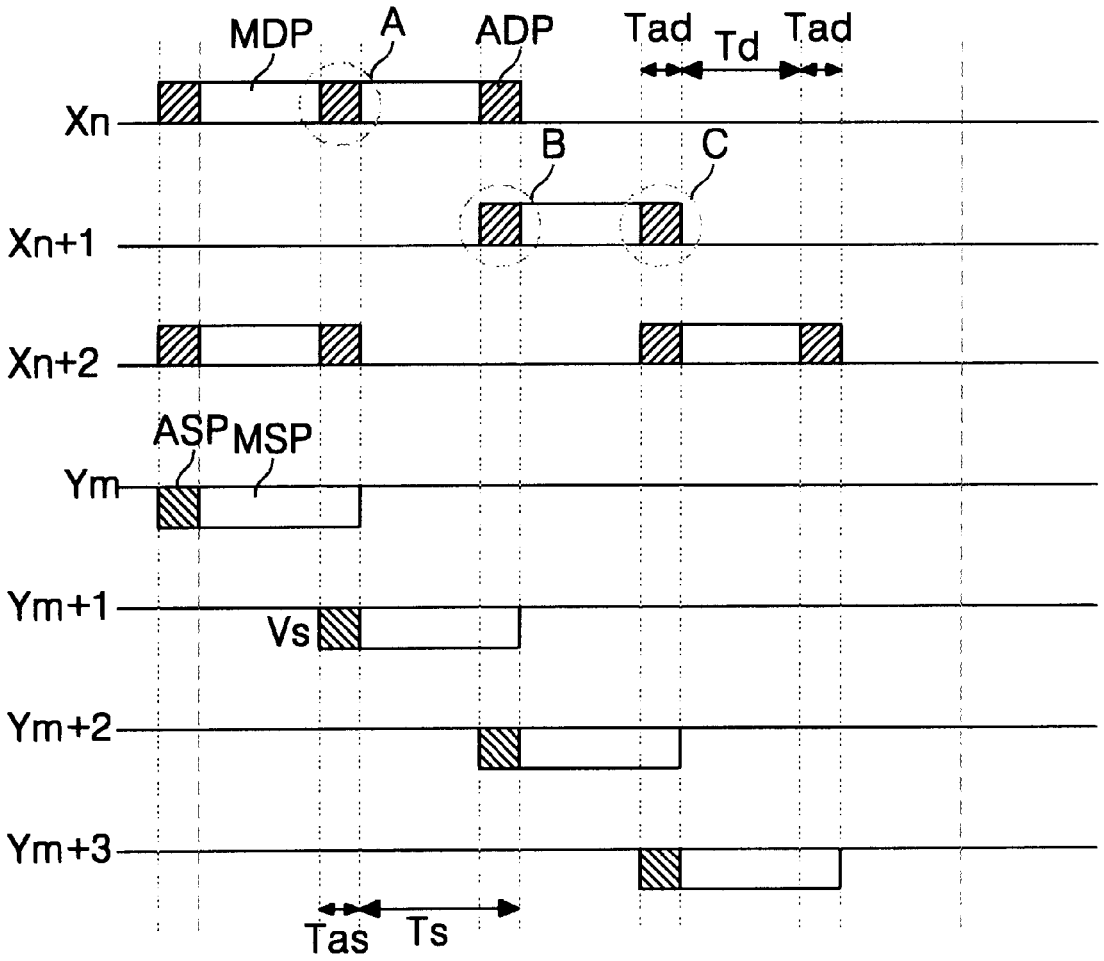
FIG. 7 is waveform diagrams showing a plasma display panel driving method according to a second embodiment of the present invention.

FIG. 7 shows driving waveforms indicating an address interval of a PDP according to a second embodiment of the present invention. Referring now to FIG. 7, in the address interval of the PDP, a scanning pulse Vs is sequentially applied to the scanning/sustaining electrode line Y and an auxiliary data pulse ADP, and a main data pulse MDP synchronized with the scanning pulse Vs applied to the scanning/sustaining electrode line Y are applied to the address electrode line X. When a data pulse having a logical value of '1' is applied to the address electrode line X, a main data pulse having a small width Td (e.g., about 1 $\mu$s) is applied. On the other hand, when a data pulse having a logical value of '0' is applied, a main data pulse MDP is not applied. Upon application of the main data pulse MDP, an auxiliary data pulse ADP having a width Tad smaller than the width Td of the main data pulse MDP is applied before and after the main data pulse MDP. The scanning pulse Vs applied sequentially to the scanning/sustaining electrode line Y is divided into a main scanning pulse MSP having a sum width (Tad+Td=Ts) of the main data pulse MDP and the auxiliary data pulse ADP and an auxiliary scanning pulse ASP having a width Tad=Tas of the main data pulse MDP or the auxiliary data pulse ADP. The main scanning pulse MSP is sequentially applied to the scanning/sustaining electrode line Y, and the auxiliary scanning pulse ASP precedes the main scanning pulse MSP. The scanning pulses Vs applied sequentially to the scanning/sustaining electrode lines Y overlap with each other by the width Tas of the auxiliary scanning pulse ASP.

An operation procedure of the driving waveforms will be described in detail below. First, when the main data pulse MDP is applied to all of the adjacent discharge cells, a single of auxiliary data pulse ADP is applied between the main data pulses MDP as indicated by the dotted circular line A in FIG. 7. When a single of main data pulse MDP is applied to a certain discharge cell, the auxiliary data pulse ADP is applied before and after the main data pulse MDP as indicated by the dotted circular lines B and C in FIG. 7. When the main data pulse MDP is not applied, the auxiliary data pulse ADP also is not applied.

Hereinafter, a method of applying the auxiliary data pulse ADP will be described.

TABLE 1

| i | Di | Di + 1 | ASP |
|---|---|---|---|
| 1 | 1 | 1 | 1 |
| 2 | 1 | 0 | 1 |
| 3 | 0 | 0 | 0 |
| 4 | 0 | 1 | 1 |
| 5 | 1 | 0 | 1 |

Figure 8:
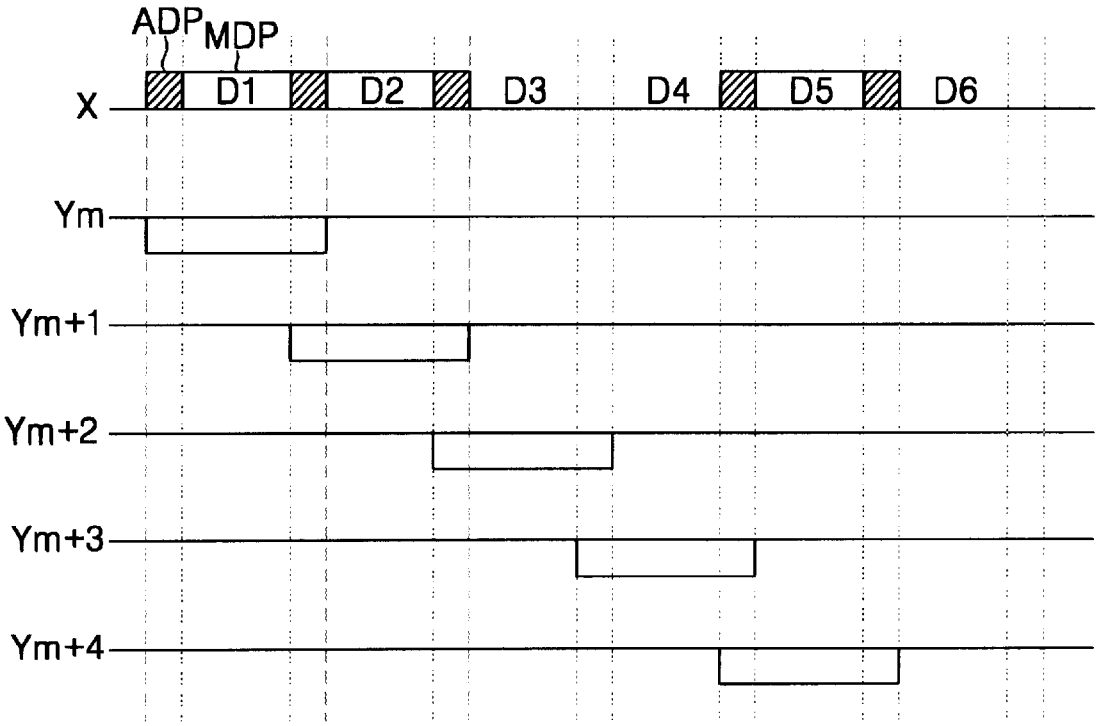
FIG. 8 is waveform diagrams showing an application process of the auxiliary data pulse in FIG. 7.

Referring to Table 1 and FIG. 8, the main data pulse MDP is applied to the first and second data D1 and D2. At this time, the auxiliary data pule ADP is applied between the first and second data D1 and D2 as seen from Table 1. The main data pulse MDP is applied to the second data D3, but it is not applied to the third data D3. At this time, the auxiliary data pulse ADP is applied after the main data pulse MDP applied to the second data D2 as seen from Table 1. The main data pulse MDP is not applied to the third and fourth data D3 and D4. Thus, the auxiliary data pulse ADP is not applied between the third and fourth data D3 and D4 as seen from Table 1. The main data pulse MDP is not applied to the fourth data D4, but it is applied to the fifth data D5. At this time, the auxiliary data pulse ADP is applied between the fourth and fifth data D4 and D5 as seen from Table 1. The main data pulse MDP is applied to the fifth data D5, but it is not applied to the sixth data D6. Thus, the auxiliary data pulse ADP is applied between the fifth and sixth data D6 as seen from Table 1. In order words, the auxiliary data pulse ADP is applied to the address electrode line X in accordance with a regulation of Table 1.

As a result, an address discharge is generated at the discharge cells supplied with the main data pulse MDP for a time of rad+Td+Tad to show an effect of increasing an address discharge time. Also, the scanning pulses Vs applied to the scanning/sustaining electrode lines Y overlap with each other by a desired time so that an address interval can be shortened by the overlapping time.

The auxiliary data pulse ADP is not applied to the discharge cells to which the main data pulse MDP is not applied so that power consumption can be minimized.

Figure 9:
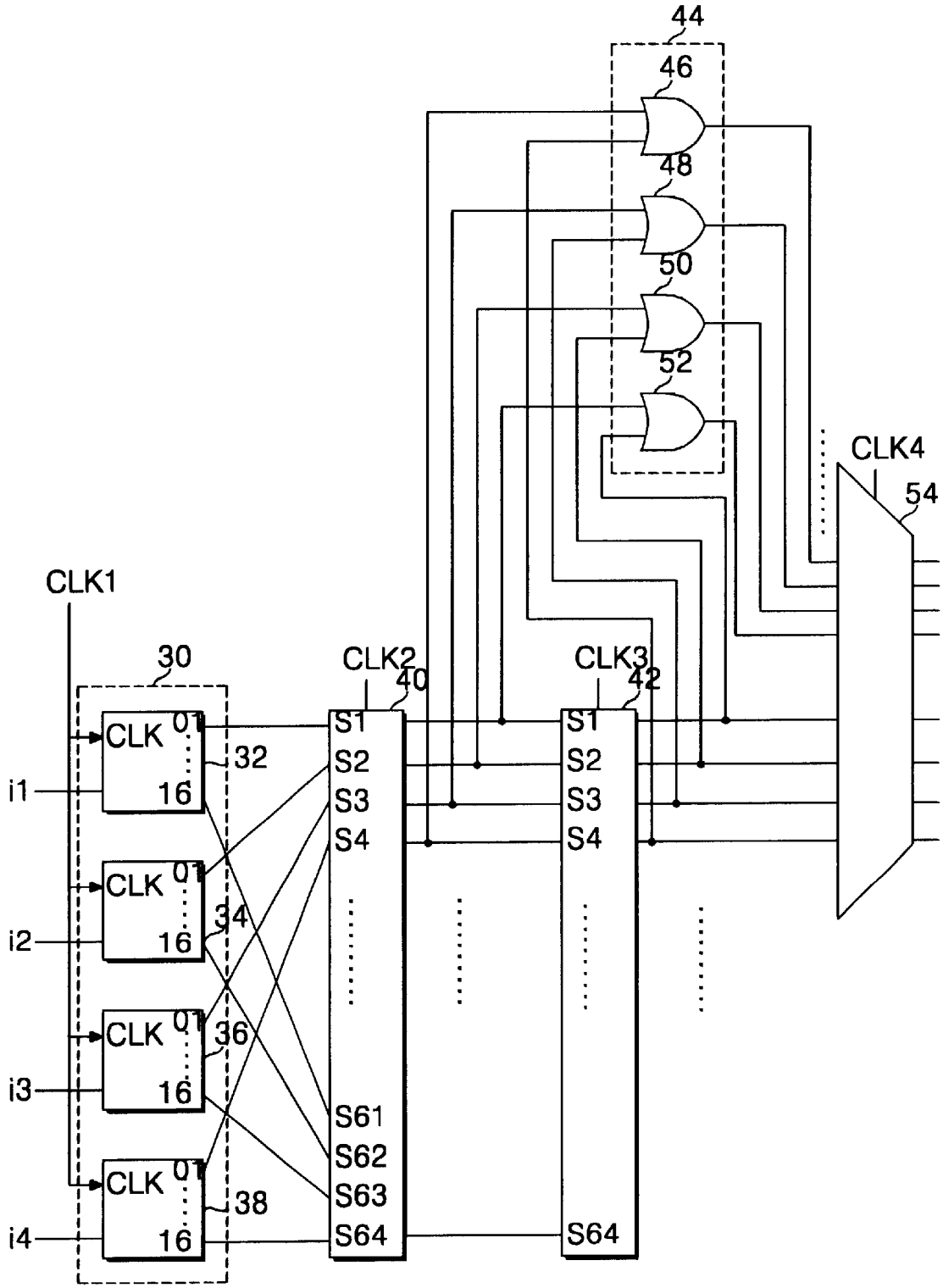
FIG. 9 shows a circuit configuration for producing the driving waveforms in FIG. 7.

FIG. 9 is a circuit diagram of an address driver for supplying a data to the address electrode lines shown in FIG. 7. Referring to FIG. 9, the address driver includes a data input 3Q, a first latch 42 for storing the current data supplied to the address electrode lines X, a second latch 40 for storing the next data supplied to the address electrode lines X, an auxiliary data pulse generator 44 for generating an auxiliary data pulse ADP using the data stored in the first and second latches 42 and 40, and a multiplexor 54 for receiving an output of the auxiliary data pulse generator 44 and an output of the first latch 42 and outputting any one of the two outputs. The data input 30 consists of four 16-bit shift registers 32, 34, 36 and 38. The shift registers 32, 34, 36 and 38 receives a data from a data supplier (not shown) and shifts the received data in synchronization with a first clock signal CLK1. If a 16-bit data is inputted to the shift registers 32, 34, 36 and 38, then the shift registers 32, 34, 36 and 38 supply the second latch 40 with the data inputted thereto. The second latch 40 receives a 64-bit data from the shift registers 32, 34, 36 and 38 and sends the received data to the first latch 42 and the auxiliary data pulse generator 44 in synchronization with a second clock signal CLK2. At the same time, the second latch 40 receives a data from the shift registers 32, 34, 36 and 38. In other words, the current data supplied to the address electrode lines X is stored in the first latch 42 while the next data supplied to the address electrode lines X is stored in the second latch 40. The first latch 42 supplies the current data being stored therein in synchronization with a third clock signal CLK3 to the auxiliary data pulse generator 44 and the multiplexor 54. The auxiliary data pulse generator 44 receives the next data delivered from the second latch 40 to the first latch 42 and the current data supplied from the first latch 42 to the multiplexor 54 to generate an auxiliary data pulse ADP, To this end, the auxiliary data pulse generator 44 consists of a plurality of OR gates 46, 48, 50 and 52. In other words, the auxiliary pulse generator 44 makes a logical sum operation of the next data and the current data to generate an auxiliary data pulse ADP. The auxiliary data pulse generator 44 includes OR gates corresponding to the number of bits (i.e., 64 bits) stored in the first and second latches 42 and 40. More specifically, if a 64-bit data is stored in the first and second latches 42 and 40, then the auxiliary data pulse generator 44 includes 64 OR gates. The auxiliary data pulse ADP generated from the auxiliary data pulse generator 44 and the current data (i.e., the main data pulse MDP) outputted from the first latch 42 are inputted to the multiplexor 54. The multiplexor 54 outputs the auxiliary data pulse ADP when a clock signal of "1" is applied to the fourth clock CLK4, whereas it outputs the main data pulse MDP when a clock signal of "0" is applied to the fourth clock CLK4.

Figure 10:
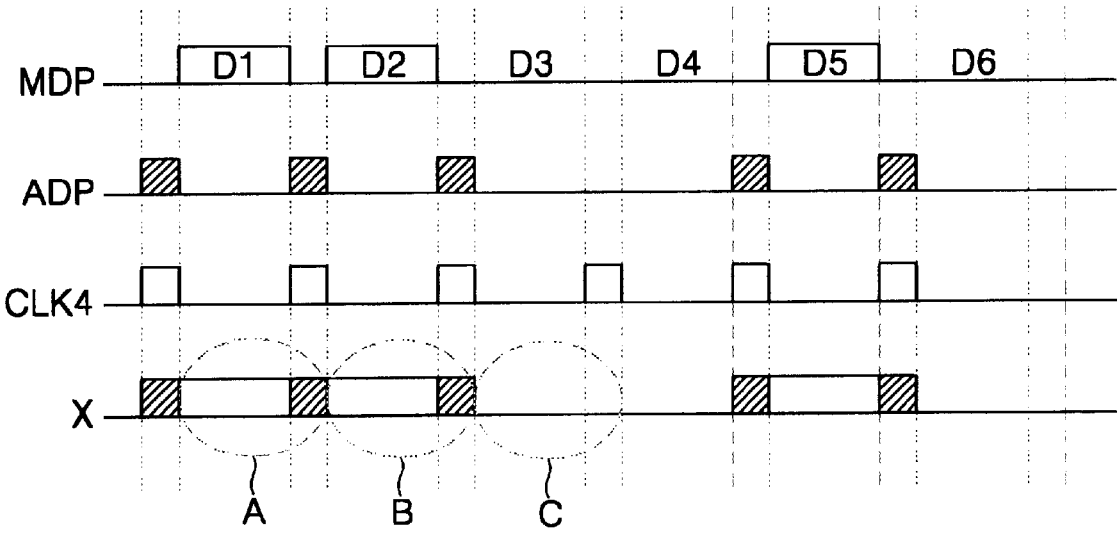
FIG. 10 is wave-form diagrams showing a process of producing the driving waveforms at the circuit configuration in FIG. 9.

Waveforms of signals outputted from the multiplexor 54 to the address electrode lines X will be described in detail with reference to FIG. 10. Referring to FIG. 10, it is assumed that a main data pulse MDP of "0" be stored in the first and second latches 42 and 40. In other words, a first data D1 is stored in the first latch 42 while a second data D2 is stored in the second latch 40. The auxiliary data pulse generator 44 receives a main data pulse MDP of "1" stored in the first and second latches 42 and 40 to generate an auxiliary data pulse ADP of "0". The main data pulse MDP of "1" stored in the first latch 42 is sent to the multiplexor 54, and the multiplexor 54 supplies the first data D1 to the address electrode line X when a clock signal of "0" is inputted to the fourth clock CLK4. Also, the multiplexor 54 applies the auxiliary data pulse ADP to the address electrode line X when a clock signal of "1" is inputted to the fourth clock CLK4. Accordingly, an address data as indicated by the dotted circular line A in FIG. 10 is supplied to the address electrode line X. Thereafter, the second data D2 is inputted to the first latch 42 while a third data D3 is inputted to the second latch 40. The auxiliary data pulse generator 44 receives the second and third data D2 and D3 stored in the first and second latches 40 to generate an auxiliary data pulse ADP of "1". The multiplexor 54 supplies the second data D2 stored in the first latch 42 to the address electrode line X when a clock signal of "0" is inputted to the fourth clock CLK4, and applies the auxiliary data pulse ADP to the address electrode line x when a clock signal of "1" is inputted to the fourth clock CLK4. Accordingly, an address data as indicated by the dotted circular line B in FIG. 10 is supplied to the address electrode line X. Thereafter, the third data D3 is inputted to the third data D3 while a fourth data D4 is inputted to the second latch 40. The auxiliary data pulse generator 44 receives the third and fourth data D3 and D4 stored in the first and second latches 42 and 40 to generate an auxiliary data pulse ADP of "0". The multiplexor 54 supplies the third data D3 stored in the first latch 42 when a clock signal of "0" is inputted to the fourth clock CLK4, and applies the auxiliary data pulse ADP to the address electrode line X when a clock signal of "1" is inputted to the fourth clock CLK4. Accordingly, an address data as indicated by the dotted circular line C in FIG. 10 is supplied to the address electrode line X. Such a process is repeated to supply an address data to the address electrode lines X.

As described above, according to the present invention, the scanning pulses are applied to the scanning/sustaining electrode lines in such a manner to overlap with each other by a desired time, thereby permitting a high-speed addressing.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A method of driving a plasma display panel including scanning/sustaining electrodes and address electrodes, comprising the steps of:

applying a data pulse to the address electrodes in an address interval for selecting discharge cells;

applying an auxiliary data pulse to the address electrodes in such a manner to be positioned at the front and rear portions of the data pulse when the data pulse is applied to the address electrodes; and sequentially applying a scanning pulse to the scanning/sustaining electrodes.

2. The method as claimed in claim 1, wherein the data pulse has a pulse width larger than the auxiliary data pulse.

3. The method as claimed in claim 1, wherein said pulse width of the scanning pulse corresponds to a width of the data pulse and a width of the auxiliary data pulse positioned at the front and rear portions of the data pulse.

4. The method as claimed in claim 1, wherein, when the data pulses are successively applied to the adjacent discharge cells, a single of auxiliary data pulse is applied between the data pulses.

5. The method as claimed in claim 1, wherein said width of the data pulse is less than 1 $\mu$s.

6. The method as claimed in claim 1, wherein the scanning pulses applied to the scanning/sustaining electrodes overlap with each other by a desired width.

7. The method as claimed in claim 6, wherein the scanning pulses applied to the scanning/sustaining electrodes overlap with each other by a width of the auxiliary data pulse.

8. A method of driving a plasma display panel including scanning/sustaining electrodes and address electrodes, comprising the steps of:

sequentially applying a scanning pulse to the scanning/sustaining electrodes in an address interval for selecting discharge cells;

applying an auxiliary scanning pulse in such a manner to be positioned at the front portion of the scanning pulse and overlap with the previous scanning pulse when the scanning pulse is applied to the scanning/sustaining electrodes; and applying any one of first and second data pulses having a different pulse width depending on a logical value of a data to the address electrodes in an address interval.

9. The method as claimed in claim 8, wherein the scanning pulse has a pulse width larger than the auxiliary scanning pulse.

10. The method as claimed in claim 8, wherein the first data pulse corresponding to the scanning pulse is applied when said data has a high logical value, and the second data pulse corresponding to the auxiliary scanning pulse is applied when said data has a low logical value.

11. The method as claimed in claim 8, wherein a minute auxiliary discharge is generated by the auxiliary scanning pulse overlapping with any one of the data pulse and the auxiliary data pulse applied during the previous line scanning time when the data pulse is applied to a certain discharge cell included in the plasma display panel, and an address discharge is generated by the data pulse applied during the current line scanning time and the scanning pulse overlapping therewith using charged particles produced by said auxiliary discharge.

12. The method as claimed in claim 8, wherein the auxiliary scanning pulse has a voltage level lower than the scanning pulse.

13. A driving apparatus for a plasma display panel, comprising:

a plurality of shift registers to each of which a data is inputted;

a plurality of memories for receiving said data stored in the shift registers and temporarily storing the received data;

an auxiliary data generator for receiving said data stored in the memories to generate an auxiliary data; and output means for receiving said data stored in the memories and said auxiliary data produced from the auxiliary data generator to output any one of said data and said auxiliary data.

14. The driving apparatus as claimed in claim 13, wherein said memories include:

a first latch for receiving a data from the shift registers; and a second latch for receiving a data from the first latch.

15. The driving apparatus as claimed in claim 14, wherein the output means includes a multiplexor for receiving a data from the second latch and said auxiliary data to output any one of said data and said auxiliary data.

16. The driving apparatus as claimed in claim 14, wherein the current data supplied to the address electrodes is stored in the second latch and the next data supplied to the address electrodes is stored in the first latch.

17. The driving apparatus as claimed in claim 16, wherein the auxiliary data generator makes a logical sum operation of said current data and said next data to generate an auxiliary data.

* * * * *